US011303005B2

(12) United States Patent
Roberts

(10) Patent No.: US 11,303,005 B2
(45) Date of Patent: Apr. 12, 2022

(54) HARMONIC COMBINER AND DIVIDER

(71) Applicant: Brock Franklin Roberts, Albuquerque, NM (US)

(72) Inventor: Brock Franklin Roberts, Albuquerque, NM (US)

( * ) Notice: Subject to any disclaimer, the term of this patent is extended or adjusted under 35 U.S.C. 154(b) by 0 days.

(21) Appl. No.: 16/873,026

(22) Filed: Jan. 16, 2020

(65) Prior Publication Data

US 2021/0226311 A1 Jul. 22, 2021

(51) Int. Cl.
*H01P 5/19* (2006.01)

(52) U.S. Cl.
CPC ..... *H01P 5/19* (2013.01)

(58) Field of Classification Search
CPC ..... H01P 5/16
See application file for complete search history.

(56) References Cited

U.S. PATENT DOCUMENTS 3,988,679 A * 10/1976 Clarke ..... G01S 7/2921 455/306
7,616,058 B1 * 11/2009 Nezakati ..... H03F 3/211 330/124 R

* cited by examiner

*Primary Examiner* — Stephen E. Jones
*Assistant Examiner* — Kimberly E Glenn

(57) ABSTRACT

The harmonic combiner and divider efficiently combines multiple harmonic signals onto a common transmission line. Combined harmonic signals can be used to generate fast, high-fidelity arbitrary waveforms by superimposing the harmonics described in their Fourier series. Fast arbitrary waveforms have applications in communications, radar, and can be used for manipulating and controlling charged particle beams. The harmonic combiner and divider also efficiently divides fast arbitrary waveforms into their constituent harmonics and provides an efficient mechanism for waveform analysis and for multi-channel communications.

7 Claims, 2 Drawing Sheets

HARMONIC COMBINER AND DIVIDER

FEDERALLY SPONSORED RESEARCH

The Department of Energy's Office of Science, Nuclear Physics program, and the Small Business Innovative Research program, grant number DE-SC0018510.

BACKGROUND

Available signal combiner and divider technologies cannot efficiently combine harmonic signals onto a common transmission line or efficiently divide an arbitrary waveform into its harmonic constituents. Waveguide combiners, hybrid combiners, Wilkinson divider/combiners and tapered line combiners to are only efficient when they are used to combine or divide signals that have the same power and frequency.

A new combiner technology is needed to efficiently combine multiple harmonic signals onto a common transmission line.

A new dividing technology is needed to efficiently divide arbitrary waveforms into their harmonic constituents.

Advantages

The harmonic combiner and divider efficiently combines multiple harmonic signals onto a common transmission line.

The harmonic combiner and divider efficiently divides an arbitrary waveform its harmonic constituents.

Combined harmonic signals can be used to generate fast, high-fidelity arbitrary waveforms by superimposing the harmonics described in their Fourier series. Fast arbitrary waveforms have applications in communications, radar, and can be used for manipulating and controlling charged particle beams.

Dividing fast arbitrary waveforms into their constituent harmonics provides an efficient mechanism for waveform analysis and for multi-channel communications.

DRAWINGS

REFERENCE NUMERALS IN DRAWING

1. Harmonic Frequency Port
2. Bandpass Filter
3. Transmission Line Loop
4. Input/Output Port

DESCRIPTION OF THE INVENTION

Figure 1:
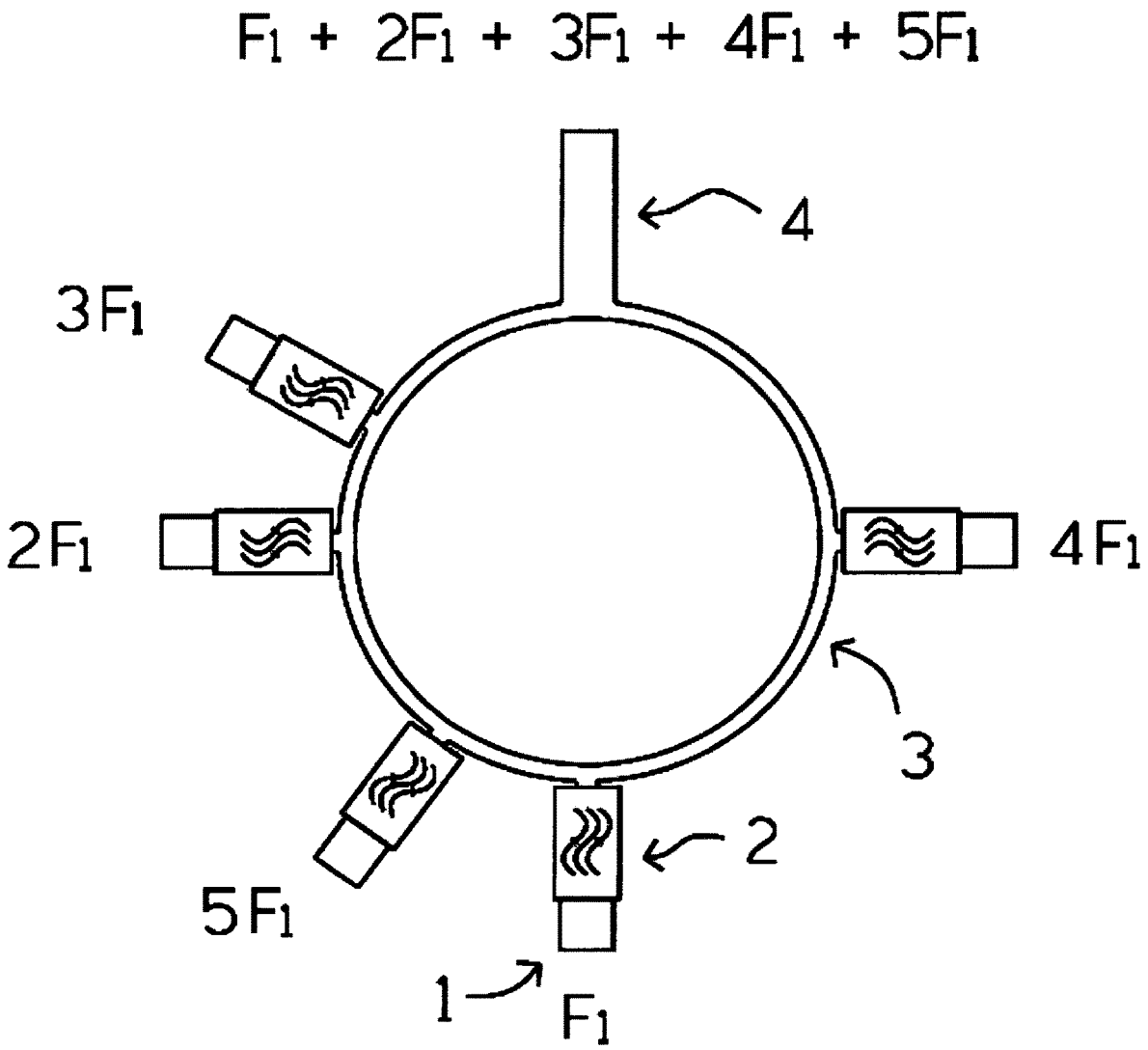
FIG. 1 shows an embodiment of the harmonic combiner and divider.

An embodiment of the harmonic combiner and divider using stripline type transmission lines is illustrated in FIG. 1. Harmonic frequency ports (1) are connected to the transmission line loop (3) through bandpass filters (2) that have harmonic passbands. The input/output port (4) is also connected to the transmission line loop (3).

The locations of the ports (1,4) along the transmission line loop (3), the loops length, and the loops impedance, are selected so that signals presented at the harmonic frequency ports (1) are evenly split into two paths along the transmission line loop (3), and constructively recombine at the loops input/output port (4). Conversely, harmonic signals presented at the input/output port (4), constructively recombine at the location of their corresponding bandpass filters (2).

Figure 2:
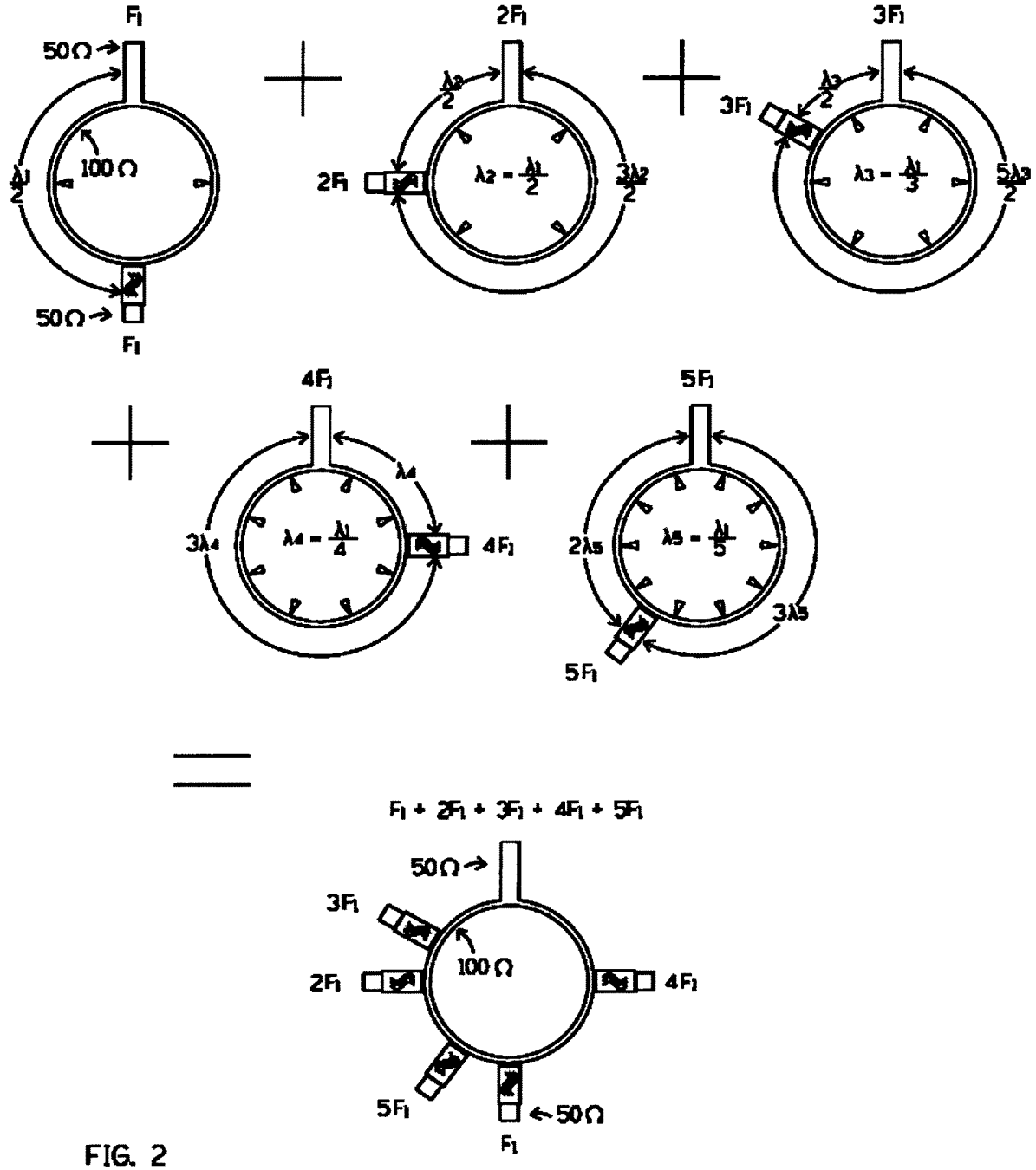
FIG. 2 illustrates the relationships between the relative locations of the ports on the transmission line loop, the loops impedance, and length.

FIG. 2 is a left to right, top to bottom sequenced illustration of a 50 Ohm embodiment of the harmonic combiner and divider. The sequence of the illustrations shows the relationships between the relative locations of the ports on the transmission line loop, its impedance, and the length of the loop, for five harmonics.

The top left frame of FIG. 2 shows 50 Ohm ports, a 100 Ohm transmission line loop impedance and transmission line loop length of one wavelength of the first harmonic. These characteristics are common to all of the frames in the sequence.

Because the impedance of two parallel 100 Ohm transmission lines is 50 Ohms, a signal from a 50 Ohm port is evenly divided onto the transmission line loop.

The location of the first harmonic frequency port in this embodiment is equidistant from the input/output port. This location ensures that the relative phasing of the split signals constructively recombine at the input/output port. Conversely, a first harmonic signal at the input port constructively recombines at its corresponding bandpass filter, and transmits to the harmonic frequency port.

The small triangles inside the illustrated transmission line loops represent locations of standing wave nulls if the loop were disconnected from its ports and resonantly excited. These points are imaginary because the loop is connected to ports, but are useful to identify locations of constructive phasing between the input/output port and the harmonic frequency ports.

The second frame of FIG. 2 shows the location of imaginary standing wave nulls of the second harmonic. The relative locations of the input/output port, and second harmonic bandpass filter are located between these points for efficient two way transmission.

The third through fifth frames similarly show locations for efficient two way transmission of individual harmonics between the input/output port and their corresponding bandpass filters.

The final frame in FIG. 2 shows all five harmonic frequency ports attached to a common transmission line loop, resembling FIG. 1. Because bandpass filters have open circuit impedance at frequencies that are outside their passband, each harmonic frequency port is isolated from one another.

OPERATION OF THE INVENTION

When in use as a harmonic combiner, multiple phase and amplitude controlled harmonic signals are input into their corresponding harmonic frequency ports (1), pass through their corresponding bandpass filters (2), travel along the transmission line loop (3) and constructively combine at the input/output port (4) as a controllable arbitrary waveform.

When in use as a harmonic divider, an arbitrary waveform presented at the input/output port 4), is split onto the transmission line loop (3) and each harmonic of the input constructively recombines at the connection of its corresponding band pass filter (2) and transmits to its corresponding harmonic frequency port (1).

Advantages of the Invention

From the description above, several advantages of some embodiments become evident.

When used as a harmonic combiner, the arbitrary waveform is efficiently created. The band pass filters isolate multiple sources from one another and prevent unwanted signals generated within the input amplifiers to reduce the fidelity of the resulting arbitrary waveform.

When used as a harmonic divider, an input arbitrary waveform is efficiently divided into its harmonic constituents. Phase and amplitude detection of each harmonic of the input waveform provides a real time Fourier series of the input. If the input arbitrary waveforms harmonic constituents were modulated, the harmonic combiner and divider provides a method for multi-channel communication.

Conclusions, Ramifications, and Scope

Accordingly, the reader will see that the harmonic combiner and divider can efficiently combine harmonics to create arbitrary waveforms and efficiently divide an arbitrary waveform into its constituent harmonics.

Although the description above contains many specificities, these should not be construed as limiting the scope of the embodiments but as merely providing illustration of one. For example, the transmission lines can be of many types including co-axial, twin line, microstrip, optical fiber etc. The 50 Ohm port impedance was selected for its popularity but could be changed. The transmission line loops are shown to be circular for clarity but could be any loop shape. The bandpass filters could be tunable to change the frequency of the arbitrary waveform to be combined or divided. Any transmission line loop length could be used with the constraint that it supports constructive interference between the harmonic frequency ports and the input/output port. While five harmonics are described, any number is possible.

I claim:

1. An apparatus for reversibly dividing arbitrary waveforms into individual constituent harmonic signals, the apparatus comprising, (a.) an input/output port and a plurality of harmonic frequency ports all having the same nominal characteristic impedance, (b.) a plurality of two port bandpass filters each having a different passband to exclusively pass a different individual constituent harmonic signal, (c.) a transmission line loop, having a predetermined length and nominal impedance that is double that of the input/output port, (d.) the input/output port being coupled to the transmission line loop so that input signals propagate in both directions around the transmission line loop, (e.) one port of each of the bandpass filters being coupled to the transmission line loop at a location where constituent harmonic signals that propagate from the input/output port in both directions around the transmission line loop and are within the bandpass filters passband constructively interfere, (f.) the second port of each said bandpass filter being coupled to one of the harmonic frequency ports, (g.) whereby, an arbitrary waveform transmitted into the input/output port is divided into individual harmonic signals available at the harmonic frequency ports, and reciprocally, individual harmonic signals transmitted into the harmonic frequency ports and pass through the bandpass filters and combine at the input/output port to create arbitrary waveforms.

2. The apparatus of claim 1 wherein the length of the transmission line loop is an integer multiple of the wavelength of the arbitrary waveform.

3. The apparatus in claim 1 wherein the input/output port impedance is nominally 50 Ohms and the transmission line loop is nominally 100 Ohms.

4. The apparatus in claim 1 wherein the transmission line loop is coaxial.

5. The apparatus in claim 1 wherein the transmission line loop is microstrip.

6. The apparatus in claim 1 wherein the transmission line loop is stripline.

7. The apparatus in claim 1 wherein the transmission line loop is optical waveguide.

* * * * *